US005759966A

United States Patent [19]

Campbell

[11] Patent Number: 5,759,966

[45] Date of Patent: Jun. 2, 1998

[54] HIGH OVERBASED METAL SULFURIZED ALKYPHENATES

[75] Inventor: Curtis B. Campbell, Hercules, Calif.

[73] Assignee: Chevron Chemical Company, San Ramon, Calif.

[21] Appl. No.: 722,734

[22] Filed: Oct. 1, 1996

[51] Int. Cl.[6] ..... C10M 135/02

[52] U.S. Cl. ..... 508/328; 508/332

[58] Field of Search ..... 508/332, 328, 508/334

[56] References Cited

U.S. PATENT DOCUMENTS

| | | | |
|---|---|---|---|
| 2,680,096 | 6/1954 | Walker et al. . | |
| 3,178,368 | 4/1965 | Hanneman . | |
| 3,367,867 | 2/1968 | Abbott et al. . | |
| 3,801,507 | 4/1974 | Hendrickson et al. . | |
| 4,248,718 | 2/1981 | Vaughan . | |
| 4,744,921 | 5/1988 | Liston . | |
| 5,024,773 | 6/1991 | Liston . | |
| 5,318,710 | 6/1994 | Campbell . | |
| 5,320,762 | 6/1994 | Campbell . | |
| 5,320,763 | 6/1994 | Campbell . | |
| 5,446,202 | 8/1995 | Nishishita et al. | 508/332 |

*Primary Examiner*—Margaret Medley
*Attorney, Agent, or Firm*—Ernest A. Schaal

[57] ABSTRACT

Process for preparing high overbased metal sulfurized alkylphenates, wherein a majority of the alkalinity is provided by at least a stoichiometric excess of metal. The process is characterized by a sulfurization reaction using a promoter, followed by overbasing with carbon dioxide, a polyamine, and additional metal base in the presence of an alkylene glycol under reactive conditions at temperatures in the range of about from 150° C. to 190° C. The process affords a metal sulfurized phenate product which is substantially insensitive to overcarbonation, which exhibits low corrosive wear, and which exhibits high rates of acid neutralization. These compositions are useful in the formulation of marine cylinder lubricants.

9 Claims, No Drawings

HIGH OVERBASED METAL SULFURIZED ALKYPHENATES

The present invention relates to processes and methods for preparing high overbased sulfurized alkylphenate compositions, which are substantially insensitive to overcarbonation, which exhibit low corrosive wear, and which exhibit high rates of acid neutralization. These compositions are useful in the formulation of marine cylinder lubricants.

BACKGROUND OF THE INVENTION

Group II metal overbased sulfurized alkylphenate compositions (sometimes referred to as "overbased phenates") are useful lubricating oil additives, which impart detergency and dispersancy properties to the lubricating oil composition, as well as providing for an alkalinity reserve in the oil. Alkalinity reserve is necessary in order to neutralize acids generated during engine operation. Without this alkalinity reserve, the acids so generated would result in harmful engine corrosion.

The preparation of overbased phenates is well known in the art and is described, for example, in U.S. Pat. Nos. 2,680,096; 3,178,368; 3,367,867; 3,801,507; and the like. The disclosures of each are incorporated herein by reference in their entirety. Typically, overbased phenates have been prepared by combining, under elevated temperatures, an alkylphenol, a neutral or overbased hydrocarbyl sulfonate, a high molecular weight alcohol, lubricating oil, a Group II metal oxide, hydroxide or $C_1$ to $C_6$ alkoxide, sulfur, and adding a polyol, typically an alkylene glycol, to the heated mixture. The water of reaction is removed and carbon dioxide added. Uncombined $CO_2$ is removed and the reaction vessel is then further heated under vacuum to remove the alkylene glycol, water, and the high molecular weight alcohol. The product is overbased by incorporation therein of hydrated lime and carbon dioxide. Typically an alkylene glycol is used to promote both the neutralization and sulfurization, and also to facilitate overbasing.

U.S. Pat. No. 4,248,718 discloses the preparation of lubricating oil additives in which a nitrogen-containing compound (such as a polyamine) is combined with a basically reacting metallic compound, a suspending agent (such as sulfurized alkylphenates), and a chalcogen compound (such as carbon dioxide). In their material, at least a third of the alkalinity value derives from the nitrogen-containing compound, and there is only from 0.05 to 0.5 equivalents of basically reacting metallic compound per equivalent of suspending agent.

A problem is encountered in the preparation of high overbased phenates. The problem occurs in the overbasing step, in which carbon dioxide is added to the phenate to increase the Total Base Number in the final product. During this overbasing step, it is well known in the art that, in general, high overbased phenates are very sensitive to the addition of too much carbon dioxide (overcarbonation). The result of adding too much carbon dioxide is the production of a product with varying quality.

SUMMARY OF THE INVENTION

The present invention is based, in part, on our discovery that sulfurized alkylphenates can be advantageously prepared which are substantially insensitive to overcarbonation, which exhibit low corrosive wear, and which exhibit high rates of acid neutralization. These compositions are obtained by modifying the overbasing step by the inclusion of a polyamine concurrently with the carbon dioxide.

A metal overbased sulfurized alkylphenate composition, having a TBN of at least 200, wherein a majority of the alkalinity is provided by at least a stoichiometric excess of metal, is prepared by contacting an alkylphenol with sulfur, in the presence of a promoter, and from 1.7 to 2.7 moles of a metal base per mole of the alkylphenol to neutralize the alkylphenol and the promoter under reactive conditions. This contacting step is carried out for a sufficient period of time to react essentially all of the sulfur. The reaction product of that contacting step is contacted with carbon dioxide and additional metal base, if required to provide the desired TBN, in the presence of an alkylene glycol having 2 to 6 carbon atoms and a polyamine under reactive conditions at temperatures in the range of about from 160° C. to 190° C.

The alkylphenol should have at least one alkyl substituent having from 9 to 36 carbon atoms, and the alkylene glycol should have from 2 to 6 carbon atoms.

Preferably, the first step of the process is conducted at temperatures in the range of about 120° C. to 200° C. More preferably, it is conducted using about from 0.8 to 3.5 moles of sulfur and from 0.025 to 2 moles of promoter per mole of alkylphenol, and a minor amount of an inert organic liquid diluent.

Preferably, the second step of the process is conducted in situ with the reaction product mixture of the first step. The second step is conducted using about 0.2 to 2 moles of carbon dioxide, about 0.1 to 0.9 moles polyamine, and 0.2 to 2 moles of alkylene glycol per moles of alkylphenol. Preferably, the alkylene glycol is ethylene glycol.

Preferably, both steps are conducted at pressures in the range of about from 25 mm Hg absolute to 850 mm Hg absolute.

Further aspects of the invention will be apparent from the following description.

DETAILED DESCRIPTION OF THE INVENTION

In its broadest aspect, the present invention involves a metal overbased sulfurized alkylphenate modified with at least one polyamine.

Prior to discussing the invention in further detail, the following terms will be defined:

DEFINITIONS

As used herein, the following terms have the following meanings, unless expressly stated to the contrary:

The term "Group II metal" or "alkaline earth metal" means calcium, barium, magnesium, and strontium.

The term "metal base" refers to a metal hydroxide, metal oxide, metal alkoxide and the like and mixtures thereof, wherein the metal is selected from the group consisting of lithium, sodium, potassium, magnesium, calcium, strontium, barium, or mixtures thereof.

The term "calcium base" refers to a calcium hydroxide, calcium oxide, calcium alkoxide, and the like, and mixtures thereof.

The term "lime" refers to calcium hydroxide, also known as slaked lime or hydrated lime.

The term "Total Base Number" or "TBN" refers to the amount of base equivalent to milligrams of KOH in 1 gram of sample. Thus, higher TBN numbers reflect more alkaline products, and therefore a greater alkalinity reserve. The TBN of a sample can be determined by ASTM Test No. D2896 or any other equivalent procedure.

The term "overbased sulfurized alkylphenate composition" refers to a composition comprising a small amount of diluent (e.g., lubricating oil) and a sulfurized alkylphenate complex wherein additional alkalinity is provided by an excess of a metal oxide above the stoichiometric amount, hydroxide or $C_1$ to $C_6$ alkoxide, based on the amount required to react with the hydroxide moiety of the sulfurized alkylphenol. Generally a carbon dioxide treatment is required to obtain high TBN overbased sulfurized alkylphenate compositions, resulting in what is believed to be a complex of the phenate with a colloidal dispersion of metal carbonate.

The term "promoter" refers to either:

(a) alkanoic acids having 1 through 3 carbon atoms, i.e., formic acid, acetic acid, and propionic acid, and mixtures thereof, or (b) alkylene polyols having from 1 to 3 carbon atoms.

The term "alkylphenol" refers to a phenol group having one or more alkyl substituents at least one of which has a sufficient number of carbon atoms to impart oil solubility to the resulting phenate additive.

SYNTHESIS

The present process can be conveniently conducted by contacting the desired alkylphenol with sulfur in the presence of a promoter and metal base under reactive conditions, preferably in an inert-compatible liquid hydrocarbon diluent. Preferably the reaction is conducted under an inert gas, typically nitrogen. In theory the neutralization can be conducted as a separate step prior to sulfurization, but pragmatically it is generally more convenient to conduct the neutralization and the sulfurization together in a single process step.

The combined neutralization and sulfurization reaction is typically conducted at temperatures in the range of about from 100° C. to 250° C., preferably 120° C. to 200° C., depending on the particular metal and promoter used. Based on one mole of alkylphenol, typically from 0.8 to 3.5, preferably from 1.2 to 2, moles of sulfur and about 0.025 to 2, preferably 0.1 to 0.8, moles of promoter are used. Typically about from 1.7 to 2.7 moles of metal base are used per mole of alkylphenol, including the base required to neutralize the promoter. The reaction is also typically conducted in a compatible liquid diluent, preferably a low viscosity mineral or synthetic oil. The reaction is preferably conducted for a sufficient length of time to ensure complete reaction of the sulfur. This is especially important where high TBN products are desired because the synthesis of such products generally requires using carbon dioxide together with polyols.

Where the neutralization is conducted as a separate step, both the neutralization and the subsequent sulfurization are conducted under the same conditions as set forth above. Optionally specialized sulfurization catalysts, such as described in U.S. Pat. No. 4,744,921, the disclosure of which is hereby incorporated in its entirety, can be employed in the neutralization-sulfurization reaction.

The sulfurized phenate product is overbased by carbonation. Such carbonation can be conveniently effected by addition of a polyol, typically an alkylene diol, e.g., ethylene glycol, and carbon dioxide to the sulfurized phenate reaction product. It is during this carbonation step that the polyamine is also added, simultaneously with the carbon dioxide and the polyol. The overbasing is typically conducted at temperatures in the range of above from 150° C. to 190° C., preferably 165° C. to 180° C., for about from 0.1 to 4 hours.

Conveniently, the reaction is conducted by the simple expedient of bubbling gaseous carbon dioxide through the reaction mixture. Excess diluent and any water formed during the overbasing reaction can be conveniently removed by distillation either during or after the reaction.

Carbon dioxide is employed in the reaction system in conjunction with the metal base to form overbased products and is typically employed at a ratio of about from 0.5 to 3 moles per mole of alkylphenol, and preferably from about 0.8 to about 2 moles per mole of alkylphenol. Preferably, the amount of $CO_2$ incorporated into the overbased sulfurized alkylphenate provides for a $CO_2$ to metal weight ratio of about from 0.45:1 to about 0.75:1. All of the metal base, including the excess used for overbasing, is added in the neutralization step.

Typically, the process is conducted under vacuum up to a slight pressure, i.e., pressures ranging from about 25 mm Hg absolute to 850 mm Hg absolute and preferably is conducted under vacuum to reduce foaming up to atmospheric pressure, e.g., about from 40 mm Hg absolute to 760 mm Hg absolute.

Additional details regarding the general preparation of sulfurized phenates can be had by reference to the various publications and patents in this technology such as, for example, U.S. Pat. Nos. 2,680,096; 3,178,368 and 3,801,507. The relevant disclosures and these patents are hereby incorporated by reference in their entirety.

Considering now in detail, the reactants and reagents used in the present process, first all allotropic forms of sulfur can be used. The sulfur can be employed either as molten sulfur or as a solid (e.g., powder or particulate) or as a solid suspension in a compatible hydrocarbon liquid.

Preferably, the metal base used is calcium hydroxide because of its handling convenience versus, for example, calcium oxide, and also because it affords excellent results. Other calcium bases can also be used, for example, calcium alkoxides.

Suitable alkylphenols which can be used in this invention are those wherein the alkyl substituents contain a sufficient number of carbon atoms to render the resulting overbased sulfurized alkylphenate composition oil-soluble. Oil solubility may be provided by a single long chain alkyl substituent or by a combination of alkyl substituents. Typically the alkylphenol used in the present process will be a mixture of different alkylphenols, substituted with $C_9$ to $C_{32}$ alkyl carbon chain. The alkyl chain can be linear, branched, or mixtures thereof.

The alkylphenols used are typically mixtures of para-alkylphenols and ortho-alkylphenols, although the predominance of either isomer can be used. Alkyl-hydroxy toluenes or xylenes, and other alkyl phenols having one or more alkyl substituents in addition to at least one long chained alkyl substituent can also be used.

In general the present process introduces no new factor or criteria for the selection of alkylphenols and accordingly the selection of alkylphenols can be based on the properties desired for lubricating oil compositions, notably TBN and oil solubility, and the criteria used in the prior art or similar sulfurization overbasing process and/or processes. For example, in the case of alkylphenate having substantially straight chain alkyl substituents, the viscosity of the alkylphenate composition can be influenced by the position of an attachment on alkyl chain to the phenyl ring, e.g., end attachment versus middle attachment. Additional information regarding this and the selection and preparation of suitable alkylphenols can be had for example from U.S. Pat.

Nos. 5,024,773, 5,320,763; 5,318,710; and 5,320,762, all of which are hereby incorporated by reference in their entirety.

If a supplemental sulfurization catalyst, such as for example desired in U.S. Pat. No. 4,744,921, is employed, it is typically employed at from about 0.5 to 10 weight % relative to the alkylphenol, and preferably at from about 1 to 2 weight %. In a preferred embodiment, the sulfurization catalyst is added to the reaction mixture as a liquid.

The overbasing procedure used to prepare the high TBN overbased sulfurized alkylphenate compositions of this invention also employs a polyol, typically a ($C_2$ to $C_4$ alkylene glycol, preferably ethylene glycol, in the overbasing step, which is added simultaneously with the polyamine.

The polyamines use in the invention having from about 2 to about 12 amine nitrogen atoms and from about 2 to about 40 carbon atoms. The polyamine preferably has a carbon to nitrogen ratio of from about 1:1 to about 10:1. The polyamine may be substituted with a substituent group selected from:

(A) hydrogen;

(B) hydrocarbyl groups from about 1 to about 10 carbon atoms;

(C) acyl groups from about 2 to about 10 carbons; and (D) monoketo, monocyano, lower alkyl and lower alkoxy derivatives of (B) and (C).

"Lower," as used in lower alkyl and lower alkoxy, means a group containing about 1 to 6 carbon atoms. "Hydrocarbyl" denotes an organic radical composed of carbon and hydrogen which may be aliphatic, alicyclic, aromatic or combinations thereof, e.g. aralkyl. The acyl groups falling within the definition of the aforementioned (C) substituents are such as pripionyl, acetyl, etc.

The more preferred polyamines finding use within the scope of the present invention are polyalkylene polyamines, including alkylene diamine and substituted polyamines, e.g. alkyl and hyroxyalkyl-substituted polyalkylene polyamines. Preferably the alkylene groups contain from 2 to 6 carbon atoms, there being preferably from 2 to 3 carbon atoms between the nitrogen atoms. Such groups are exemplified by ethyleneamines and including ethylene diamine, diethylene triamine, di(trimethylene) triamine, dipropylenetriamine, triethylenetetramine, etc. Such amines encompass isomers which are the branched-chain polyamines and the previously mentioned substituted polyamines, including hydroxy and hydrocarbyl-substituted polyamines. Among the polyalkylene polyamines, those containing 2 to 12 amine nitrogen atoms and 2 to 24 carbon atoms, are especially preferred and the $C_2$ to $C_3$ alkylene polyamines are most preferred, in particular, the lower polyalkylene polyamines, e.g. ethylene diamine, tetraethylenepentamine, etc.

A Group II metal neutral or overbased hydrocarbyl sulfonate can be employed at from about 1 to 10 weight % relative to the alkylphenol, preferably from about 1 to 5 weight %. Where the product is intended as an additive for marine crankcase lubricated oil formulations the use of Group II metal neutral or overbased hydrocarbyl sulfonate is especially attractive because sulfonates are advantageously employed in such formulations in conjunction with the overbased sulfurized alkylphenates.

Suitable Group II metal neutral or overbased hydrocarbyl sulfonates include natural or synthetic hydrocarbyl sulfonates such as petroleum sulfonate, synthetically alkylated aromatic sulfonates, or aliphatic sulfonates such as those derived from polyisobutylene. These sulfonates are well-known in the art. (Unlike phenates, "normal" sulfonates are neutral and hence are referred to as neutral sulfonates.) The hydrocarbyl group must have a sufficient number of carbon atoms to render the sulfonate molecule oil soluble. Preferably, the hydrocarbyl portion has at least 20 carbon atoms and may be aromatic or aliphatic, but is usually alkylaromatic. Most preferred for use are calcium, magnesium or barium sulfonates that are aromatic in character. Such sulfonates are conventionally used to facilitate the overbasing by keeping the calcium base in solutions.

Sulfonates suitable for use in the present process are typically prepared by sulfonating a petroleum fraction having aromatic groups, usually mono- or dialkylbenzene groups, and then forming the metal salt of the sulfonic acid material. The sulfonates can optionally be overbased to yield products having Total Base Numbers up to about 400 or more by addition of an excess of a Group II metal hydroxide or oxide and optionally carbon dioxide. Calcium hydroxide or oxide is the most commonly used material to produce the basic overbased sulfonates.

It is generally advantageous to use a small amount of an inert hydrocarbon diluent and solvent in the process to facilitate mixing and handling of the reaction mixture and product. Typically, a mineral oil will be used for this purpose because of its obvious compatibility with the use of the product in lubricating oil combinations. Suitable lubricating oil diluents which can be used include for example, solvent refined 100N, i.e., Cit-Con 100N, and hydrotreated 100N, i.e., RLOP 100N, and the like. The inert hydrocarbon diluent preferably has a viscosity of from about 1 to about 20 cSt at 100° C.

In the general preparation of overbased sulfurized alkylphenates, demulsifiers are frequently added to enhance the hydrolytic stability of the overbased sulfurized alkylphenate and may be similarly employed in the present process if desired. Suitable demulsifiers which can be used include, for example, nonionic detergents such as, for example, sold under the Trademark Triton X45 and Triton X-100 by Rohm and Haas (Philadelphia, Pa.) and ethoxylated p-octylphenols. Other suitable commercially available demulsifiers include Igepal CO-610 available from GAF Corporation (New York, N.Y.). Where used, demulsifiers are generally added at from 0.1 to 1 weight % to the alkylphenol, preferably at from 0.1 to 0.5 weight %.

LUBRICATING OIL COMPOSITIONS

The oil-soluble, overbased sulfurized alkylphenate compositions produced by the process of this invention are useful lubricating oil additives imparting detergency and dispersancy properties to the lubricating oil as well as providing an alkalinity reserve in the oil. When employed in this manner, the amount of the oil-soluble, overbased sulfurized alkylphenate composition ranges from about 0.5 to 40 weight % of the total lubricant composition, although preferably from about 1 to 25 weight % of the total lubricant composition. Such lubricating oil compositions are useful in diesel engines, gasoline engines, as well as in marine engines. As noted above, when used in lubricating oil formulations for marine engines, such phenates are frequently used in combination with Group II metal overbased natural or synthetic hydrocarbyl sulfonates.

Such lubricating oil compositions employ a finished lubricating oil, which may be single or multigrade. Multigrade lubricating oils are prepared by adding viscosity index (VI) improvers. Typical viscosity index improvers are polyalkyl methacrylates, ethylene, propylene copolymers, styrene-diene copolymers, and the like. So-called dispersant VI improvers, which exhibit dispersant properties as well as VI modifying properties, can also be used in such formulations.

The lubricating oil, or base oil, used in such compositions may be mineral oil or synthetic oils of viscosity suitable for use in the crankcase of an internal combustion engine, such as gasoline engines and diesel engines, which include marine engines. Crankcase lubricating oils ordinarily have a viscosity of about 1300 cSt 0° F. to 24 cSt at 210° F. (99° C.). The lubricating oils may be derived from synthetic or natural sources. Mineral oil for use as the base oil in this invention includes paraffinic, naphthenic and other oils that are ordinarily used in lubricating oil compositions. Synthetic oils include both hydrocarbon synthetic oils and synthetic esters. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity, such as didodecyl benzene, can be used. Useful synthetic esters include the esters of both monocarboxylic acid and polycarboxylic acids, as well as monohydroxy alkanols and polyols. Typical examples are didodecyl adipate, pentaerythritol tetracaproate, di-2-ethylhexyl adipate, dilaurylsebacate and the like. Complex esters prepared from mixtures of mono and dicarboxylic acid and mono and dihydroxy alkanols can also be used.

Blends of hydrocarbon oils with synthetic oils are also useful. For example, blends of 10 to 25 weight % hydrogenated 1-decene trimer with 75 to 90 weight % 150 SUS (100° F.) mineral oil gives an excellent lubricating oil base.

Other additives which may be present in the formulation include rust inhibitors, foam inhibitors, corrosion inhibitors, metal deactivators, pour point depressants, antioxidants, and a variety of other well-known additives.

EXAMPLES

The invention will be further illustrated by following examples, which set forth particularly advantageous method embodiments. While the Examples are provided to illustrate the present invention, they are not intended to limit it.

Neutralization Rate Test

The Neutralization Rate Test (NRT) consists of recording the increase in pH of a continuously stirred heterogeneous mixture of aqueous acid and lubricating oil by means of a glass pH electrode as a function of time at 25° C. The results of the test are represented as the time necessary to reach an inflection point and/or a certain basic pH value (i.e., >pH 7). The shorter the time to reach a basic pH value, the better the oil is at neutralizing acid.

Example 1

Preparation of an EDA Modified HOB Phenate From a Linear Alkyl Alkylphenol

Into a 2 liter 5-neck round bottom flask was weighed 24.4 grams of a neutral sulfonate, 381.1 grams of a $C_{20-28}$ linear alkyl-chain substituted alkylphenol, 239.1 grams of decyl alcohol, 103.4 grams of diluent oil (RLOP 100N available from Chevron) and 176.1 grams of lime. The flask was fitted with a reflux condenser, placed under a slight nitrogen purge, and the agitator turned on. The contents were then heated to 65° C. over fifteen minutes. At 65° C., 47.2 grams of solid sulfur was added to the flask and the temperature was held at 65° C. for thirty minutes. The reflux condenser was changed to a distillation configuration and the reaction temperature was then increased to 151° C. over 35 minutes and held at 151° C. for sixty minutes. Ten minutes into this sixty minute hold step, 21.8 grams of ethylene glycol was added to the reaction over thirty minutes. The temperature was then increased to 171° C. over sixty minutes. At 171° C., the nitrogen purge was stopped and the addition of 84.8 grams of ethylene glycol over 58 minutes was started simultaneously with the addition of 71 grams of carbon dioxide over 160 minutes. Ten minutes into this simultaneous addition of ethylene glycol and $CO_2$, 47.6 grams of ethylene diamine (EDA) was added over 95 minutes using an addition funnel. Following the addition of the $CO_2$, the reaction was held at 171° C. for twenty minutes and then the reaction was distilled by heating to 205° C. over 35 minutes while reducing the vacuum on the system to 26 mm Hg. The temperature was held at 205° C. for thirty minutes at 26 mm Hg vacuum. The reaction was then cooled to about 150° C. and the vacuum released with nitrogen and approximately 25 ml of product was removed for crude sediment analysis (4.0 vol. %). The product was then diluted with approximately 300 ml of Chevron 225 thinner and filtered through a Buchner funnel with the aid of filter aid.

The filtered product was distilled to remove the thinner to afford 284.8 grams of final product having the following properties: TBN=333; Ca=1.2 weight %; S=2.67 weight %; N=0.88 weight %; $CO_2$=8.8 weight %; Viscosity=203 cSt (100° C.).

Example 2

Preparation of an EDA Modified HOB Phenate From a Branched Alkylphenol

Into a 3 liter 5-neck round bottom flask was weighed 823.4 grams of dodecyl alkylphenol, 516.6 grams of diluent oil (RLOP 100N), 71.5 grams of a neutral sulfonate, and 0.2 grams of an antifoam agent (silicone oil) at atmospheric pressure. The flask was fitted with a distillation head and the agitator started. The contents of the flask were heated to 110° C. over thirty minutes. When the reaction reached approximately 70° C., 368 grams of lime were added. When the reaction reached 110° C., 119 grams of solid sulfur were added and the vacuum was reduced to approximately 680 mm Hg. The reaction was then heated to 160° C. over twenty minutes. When the reaction reached 160° C., 100 grams of 2-ethylhexanol was added over approximately thirty minutes followed by 148.9 grams of ethylene glycol which was added over sixty minutes. Following the addition of the ethylene glycol; the vacuum was increased to 720 mm Hg, 228 grams of 2-ethyl-hexanol was added over sixty minutes and the temperature increased to 165° C. over 75 minutes. The reaction temperature was held at 165° C. and 720 mm Hg vacuum for 45 minutes. The reaction flask was then brought to atmospheric pressure and: the temperature was increased to 170° C. over 15 minutes; a mixture of 54 grams of ethylene diamine and 85.1 grams of ethylene glycol was added over 165 minutes and 108 grams of carbon dioxide was added according to the following rates: 0.74 grams/minute for 15 minutes; 0.97 grams/minute for sixty minutes and finally 0.76 grams/minute for 51 minutes. At the end of the $CO_2$ addition, the reaction was distilled by increasing the temperature to 195° C. over 45 minutes while the vacuum was gradually decreased to 40 mm Hg. When the reaction reached 195° C., it was held at 195° C. and 40 mm Hg for one hour. The reaction was then cooled to approximately 160° C. and the flask brought to atmospheric pressure with nitrogen gradually. When the reaction reached 160° C., a 25 ml aliquout was removed for crude sediment analysis (1.6 vol. %). The reaction was filtered hot (150°–160° C.) through a pressure Buchner filter with the aid of nitrogen pressure (70–80 psi) and filter aid at a rate of 420 kg/hour/$m^2$.

The filtered product had the following properties: TBN=293; Ca=9.69 weight %; S=3.71 weight %; N=0.76 weight %; $CO_2$=5.17 weight %; Viscosity=420 cSt (100° C.).

Example 3

Preparation of an EDA Modified HOB Phenate from a Branched Alkylphenol

The procedure of Example 2 was followed exactly except 150 grams of carbon dioxide was added using the following flow rates: 11 grams at 0.73 grams/minutes then 52.5 grams at 0.88 grams/minute and finally 86.5 grams at 0.74 grams/minute. Following distillation of the reaction, an aliquout of the reaction was removed for crude sediment analysis (1.2 Vol. %). The filtered product had the following properties: TBN=299; Ca=9.66 weight %; S=3.69 weight %; N=0.86 weight %; $CO_2$=6.0 weight %; Viscosity=359 cSt (100° C.).

Comparative Example A

A commercially available metal overbased sulfurized dodecyl alkylphenol was used prepared from the same branched alkyl phenol used in Examples 2 and 3, but not containing any polyamine. The Comparative Example A product typically has the following properties: TBN=250; Ca=9.25 weight %; S=3.37 weight %; $CO_2$=5.0 weight %; Viscosity=350 cSt (100° C.).

Neutralization Rate Test Results

The following Table summarizes results showing the improved sulfuric acid neutralization efficacy of two EDA modified HOB phenates compared to a non-EDA modified phenate in 70 BN oils.

| Detergent Tested | Test Method | Time (sec) to Reach pH 9 |
|---|---|---|
| Comparative Ex. A | 20 mls test oil and 40 ml 0.02 N $H_2SO_4$ | 1730 |
| Ex. 2 | 20 mls test oil and 40 ml 0.02 N $H_2SO_4$ | 1440 |
| Comparative Ex. A | 10 mls test oil and 50 ml 0.002 N $H_2SO_4$ | 340 |
| Ex. 2 | 10 mls test oil and 50 ml 0.002 N $H_2SO_4$ | 160 |
| Ex. 3 | 10 mls test oil and 50 ml 0.002 N $H_2SO_4$ | 303 |

From the results shown in the above table, it is clear that the EDA modified metal overbased sulfurized alkylphenates show increased efficiency at neutralizing sulfuric acid, which is the main contribution to corrosive wear in slow speed crosshead diesel engines. Thus, when used in the formulation of marine cylinder lubricants (MCL's) it would be expected that these EDA modified metal overbased sulfurized alkylphenates will exhibit improved wear relative to metal overbased sulfurized alkylphenates not modified with polyamines.

While the present invention has been described with reference to specific embodiments, this application is intended to cover those various changes and substitutions that may be made by those skilled in the art without departing from the spirit and scope of the appended claims.

What is claimed is:

1. A process for preparing a polyamine-modified metal overbased sulfurized alkylphenate composition having a TBN of at least 200, wherein the process comprises the steps of:

(a) contacting an alkylphenol, having at least one alkyl substituent having from 9 to 36 carbon atoms, with sulfur, in the presence of a promoter, and from 1.7 to 2.7 moles of a metal base per mole of said alkylphenol, under reactive conditions for a sufficient period of time to react essentially all of said sulfur, thereby yielding a metal sulfurized alkylphenate, wherein said metal base is selected from the group consisting of metal hydroxide, metal oxide, metal alkoxide and mixtures thereof, and wherein the metal is selected from the group consisting of lithium, sodium, potassium, magnesium, calcium, strontium, barium, or mixtures thereof; and (b) contacting the reaction product of step (a) with carbon dioxide and a polyamine in the presence of an alkylene glycol having 2 to 6 carbon atoms under reactive conditions at temperatures in the range of about from 150° C. to 190° C.

2. The process according to claim 1 wherein said polyamine has from about 2 to about 12 amine nitrogen atoms and from about 2 to about 40 carbon atoms.

3. The process according to claim 1 wherein step (a) of said process is conducted at temperatures in the range of about 120° C. to 200° C.

4. The process according to claim 1 wherein step (a) is conducted using about from 0.8 to 3.5 moles of said sulfur and from 0.025 to 2 moles of said promoter per mole of said alkylphenol, and a minor amount of an inert organic liquid diluent.

5. The process according to claim 4 wherein step (b) is conducted in situ with the reaction product mixture of step (a) and wherein said step (b) is conducted using about 0.5 to 2 moles of carbon dioxide, about 0.1 to 0.9 moles polyamine, and 0.2 to 2 moles of said alkylene glycol per moles of said alkylphenol.

6. The process according to claim 5 wherein said alkylene glycol is ethylene glycol.

7. The process according to claim 5 wherein said steps (a) and (b) are conducted at pressures in the range of about from 25 mm Hg absolute to 850 mm Hg absolute.

8. A polyamine-modified metal overbased sulfurized alkylphenate prepared according to the process of claim 1.

9. A lubricating composition containing a major part of lubricating oil and a minor part of a polyamine-modified metal overbased sulfurized alkylphenate prepared according to the process of claim 1.

* * * * *

UNITED STATES PATENT AND TRADEMARK OFFICE

CERTIFICATE OF CORRECTION

PATENT NO : 5,759,966

DATED : June 2, 1998

INVENTOR(S) : Curtis B. Campbell

It is certified that error appears in the above-identified patent and that said Letters Patent is hereby corrected as shown below:

Title page, item [54] and column 1, lines 1-2,

Cover Page: [54] "HIGH OVERBASED METAL SULFURIZED ALKYPHENATES"
should be
-- HIGH OVERBASED METAL SULFURIZED ALKYLPHENATES --.

Signed and Sealed this

Sixth Day of June, 2000

*Attest:*

Q. TODD DICKINSON

*Attesting Officer*

*Director of Patents and Trademarks*